US006165045A

United States Patent [19]

Miller et al.

[11] Patent Number: 6,165,045

[45] Date of Patent: Dec. 26, 2000

[54] BRASSIERE FOR LARGE BREASTED, ATHLETIC WOMEN

[76] Inventors: Evelyn Miller; Douglas D. Miller, both of 424 Ashwood Dr., Lawrenceville, Ga. 30043

[21] Appl. No.: 09/390,779

[22] Filed: Sep. 7, 1999

[51] Int. Cl.[7] ..... A41C 3/00

[52] U.S. Cl. ..... 450/1; 450/17

[58] Field of Search ..... 450/1, 2, 17, 19, 450/20, 21, 60, 61, 62, 63, 74–76

[56] References Cited

U.S. PATENT DOCUMENTS 4,289,137 9/1981 Dell et al. ..... 450/58
4,432,364 2/1984 Martini ..... 450/60

*Primary Examiner*—Gloria M. Hale
*Attorney, Agent, or Firm*—Harry I. Leon; Vivian L. Steadman

[57] ABSTRACT

A bra for large breasted women which is both comfortable to wear and allows a user to engage in vigorous physical activity without experiencing discomfort to her breasts. The bra comprises a pair of molded cups, each of which is mounted in a non-stretchable harness member that encircles the breast giving it firm support. Also attached to the harness member is a soft, stretchable cloth cover. The cover both enhances the appearance of the bra and provides additional support for the breast. The two harness members, which are generally mirror images of each other, are removably fastened together in the front by a heavy duty zipper. Rearwardly, each individual harness member is supported by three straps which encircle the user's body. Among these straps are an elastic waistband, a wide shoulder strap of adjustable length, and an underarm strap. The underarm and shoulder straps are joined to the harness member at points distal from the zipper and proximate with the upper and lower edges, respectively, of the molded cup mounted in the harness member. The two pairs of shoulder and underarm straps are connected together, forming a yoke, in the center of the back. Flexibility to provide freedom of movement is found in a pair of elastic inserts. The first insert is located within the harness member itself between the shoulder and underarm strap attachment points; and the second insert in the otherwise non-stretchable underarm strap

8 Claims, 4 Drawing Sheets

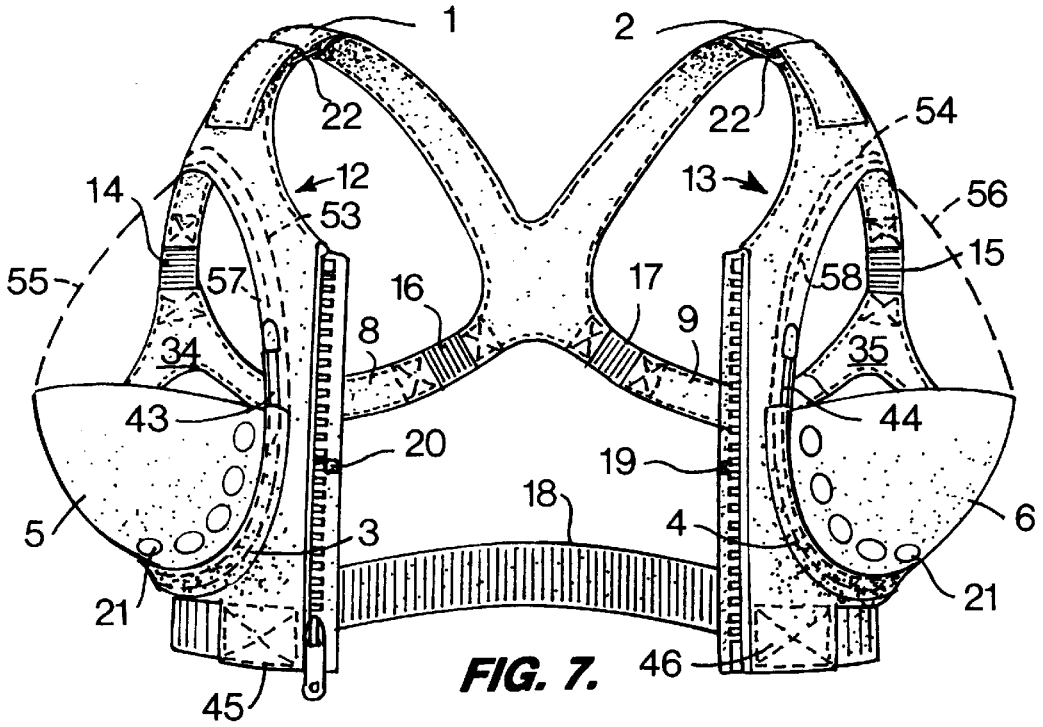
FIG. 7.
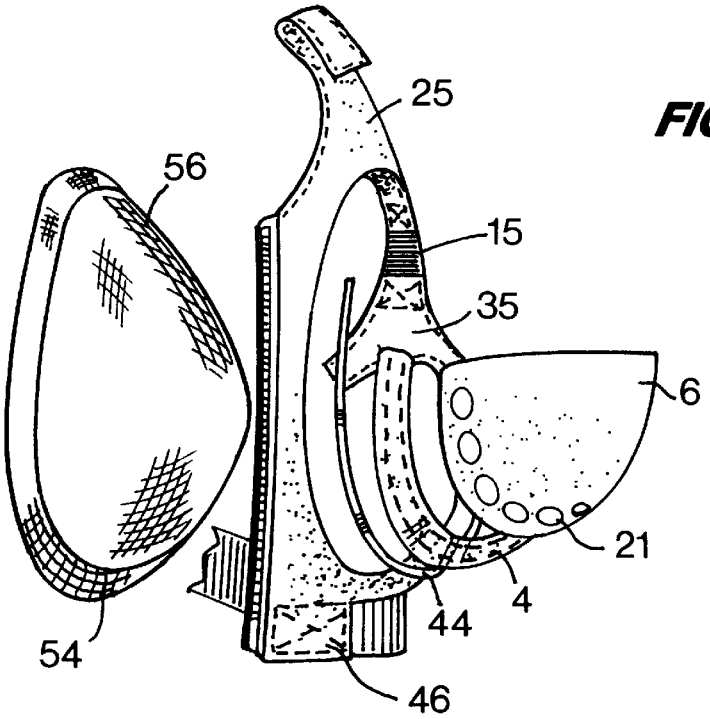
FIG. 8.
FIG. 9.
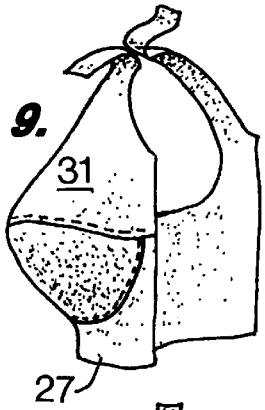
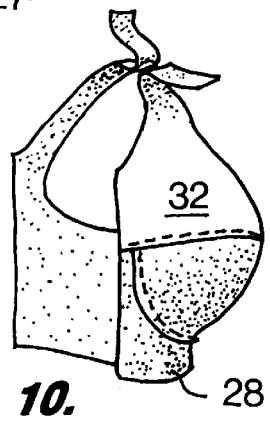
FIG. 10.

BRASSIERE FOR LARGE BREASTED, ATHLETIC WOMEN

FIELD OF THE INVENTION

The invention is in the field of women's sports attire.

BACKGROUND OF THE INVENTION

In the prior art, most sports bras for large breasted women include an elastic band which flattens the breast against the chest. U.S. Pat. Nos. 4,957,466, 4,816,005, 4,583,544 and 4,325,378 disclose such an elastic band. Its inclusion, however, usually makes a garment very uncomfortable for a sports woman to wear.

More recent patents, such as U.S. Pat. No. 5,823,851, which was issued to Dicker on Oct. 20, 1998, disclose bras which are designed to hold the breast in a pocket and which have supporting straps that pass over the shoulders and around the back. Some women engaged in active sports report that Dicker's bra does not give them adequate support and even restricts their movements.

SUMMARY OF THE INVENTION

The object of the present invention is to provide a comfortable support bra for large breasted, athletic women.

A further object of this invention is to provide such a bra that not only prevents any injury induced when the breast and related tissue inadvertently bounce relative to the rest of a woman's body but also permits the wearer to enjoy maximum freedom of motion.

It shall be clear upon further reading of the specification and drawings that the brassiere disclosed in this application can be sold by standard measurements and cup sizes. However, those women who desire to optimize the degree of support which this bra offers will benefit greatly by having it custom-fitted. A method of custom fitting this bra is also disclosed herein.

In accordance with the present invention, there is provided an improved sports bra which can fully support the breasts without binding them and at the same time nearly eliminates the likelihood of their bouncing. Furthermore, this improved bra gives full support without restricting a user's motion. The improved bra comprises a pair of cups and other breast covering elements, a pair of harness members, each of which holds breast covering elements in place, and means, including a zipper and straps, for securing the harness members to the user's body.

Sized to fit the lower half of a wearer's breast, each cup is preferably fabricated from a hot molded foam. A ring of vent holes formed along the lower edge of the cup helps to cool the breast and allow perspiration to escape. Also, the exterior surface of the cup as well as the remainder of the breast area is covered with a light, stretchable material which absorbs moisture, wicks it away from the body so that moisture can evaporate, and is porous enough to filter air, further enhancing the capability of the improved sports bra to keep the breast cool and dry.

Even though it encircles the breast, each harness member does not contact the soft tissue of the breast. Rather it contacts only the surrounding rib cage area. Made from a non-stretchable washable material, each harness member also preferably includes a flange and an underwire. The under-wire is held in place by an arcuate row of double stitching which joins the flange to the harness member and is situated in the lower half thereof adjacent to the periphery of the cup Above the breast, on the other hand, each harness member is substantially less rigid so that a wearer can enjoy a high degree of freedom of motion. In the preferred embodiment, a small elastic insert connects those portions of the harness member to which the shoulder and underarm straps, respectively, are attached.

Included in the means for securing the harness members to the user's body is a pair of shoulder straps, each of which extends upwardly from its juncture with one of the harness members and, when worn, passes to one side of the neck and over the shoulder. Fabricated from material similar to that of the harness, each shoulder strap is constructed in two parts joined together by a buckle. The latter is attached to the strap in such a way that it contacts the user's body just below the clavicle bone, fitting into a natural hollow located on the torsoso that the buckle is unobstrusive. Moreover, the underside of the shoulder strap is preferably fitted with a soft padding, a flap of which protrudes into this hollow, cushioning the buckle from the user's body. The end of each shoulder strap distal from the buckle terminates in a yoke, which, in used is worn in the center of the back.

Extending laterally from each harness member is one of two underarm straps, both of which, like the shoulder straps, are connected to the yoke. The juncture of each underarm strap with the front of the harness member is disposed roughly on the same imaginary horizontal plane as that in which the center of the breast or nipple lies. Each underarm strap, when worn, passes beneath a laser's arm and then curves upwardly, terminating in the yoke. For extra flexibility, a small elastic insert is included in each underarm strap.

The waistband, made of an elastic material, encircles the user's rib cage about one inch below the lowermost surface of the breast. The ends of the waistband are connected to a pair of non-stretchable fabric panels disposed proximate with and connected to the zipper.

The zipper itself, elements of which are mounted on both harness members, is used to close the front of the bra. To facilitate closure of the zipper, one or more small hook and eye-type fasteners are preferably used to bring the two harness members together prior to pulling the zipper closure shut.

Those portions of the improved bra which are disposed between the straps and waistband and between the straps and the panels attached to the lower end of the zipper are covered with a porous, stretchable material, the same or a similar material to that which is used to cover the breast area including the preformed cups. This stretchable material forms an outer covering which absorbs moisture and wicks it away from the body to allow excess water to evaporate. The porosity of this outer covering is such that air can filter through it, keeping the area around the user's breast cool and dry.

Prior to putting the bra on, a user unzips it. Then a person can place her arms one at a time between the shoulder and underarm straps in each harness member. The front is then partially closed, joining the harness members with the use of one or more hook and eye-type fasteners, which also help to align the teeth in the opposing sides of the zipper. Finally, the zipper is closed; and the bra is adjusted by sliding the shoulder straps through the buckles and gently pulling on them until a small amount of tension is applied to each strap. The shoulder straps are locked in position by pressing together hook-and-loop-type fasteners attached to the straps themselves.

BRIEF DESCRIPTION OF THE DRAWINGS

FIG. 7 is a frontal elevational view of the sports bra according to FIG. 1, the bra being depicted with its zipper open and its outer cloth covering removed so as to expose the harness members and a pair of preformed cups attached thereto, a flanged liner which is attached to the inside of each cup being shown with a dotted line;

FIG. 8 is an exploded, right side perspective view of a fragmentary portion of the sports bra according to FIG. 1, the outer cloth covering having been removed; and FIGS. 9 and 10 are frontal perspective views of first and second halves of the outer cloth covering which, as shown in FIG. 1, is stitched to the harness members of the sports bra according to the present invention

DETAILED DESCRIPTION OF THE PREFERRED EMBODIMENT

Figure 1:
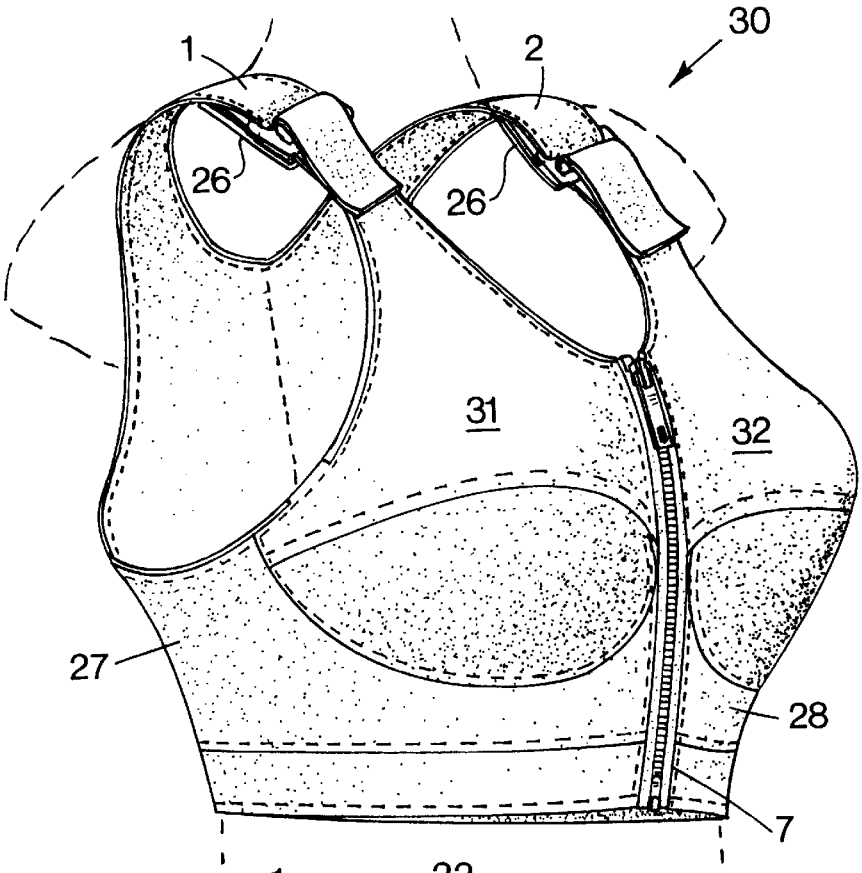
FIG. 1 is a frontal right side perspective view of the sports bra according to the present invention, the dashed line showing the torso of a typical user and forming no part of the claimed invention.

Referring now to the drawings, there is illustrated a sports bra according to the present invention, the bra being indicated generally by the reference numeral 30. The bra 30 comprises a pair of harness members 12, 13, breast covering elements 5, 6, 31, 32, which are attached thereto, and means, including two sets of straps 1, 8; 2, 9, a waistband 18 and a zipper 7, for securing the harness members to the user's body.

Mounted within an opening defined by each harness member 12, 13 is a preformed cup 5, 6 and a flanged liner 55, 56. Preferably fabricated from a hot molded foam, each cup 5, 6 is shaped to form a soft supporting pocket for approximate the lower one-half of the breast (FIGS. 2, 3, 5–8). Means for venting the cups 5, 6 so as to allow for air circulation beneath them comprises a plurality of holes 21 disposed along the lower edge of each cup. The vent holes 21 h cool the breast and allow perspiration to escape.

As best seen in FIGS. 7, 8, each liner 55, 56, which is made of polyester or the like, is bonded or alternately, stitched to the inside of the cups 5, 6. Liner flances 53, 54 attached to the harness member 12, 13 by stitches 57, 58 (FIGS. 7, 8). Among manufactures that can fabricate suitable liners 56 and cups 5, 6 are Metric Products located in Culver City, Calif. 90232 and Fiber Dynamics, Inc., Division of Sommers, Inc. located in High Point, N.C. 27261, respectively.

Overlying the cups 5, 6 as well as the rest of the breast area are outer cloth coverings 31, 32 made of a light, stretchable material (FIGS. 1, 9. 10). Porous in nature the cloth coverings 31, 32 absorb moisture and wick it away from the user's body so that water can simultaneously evaporate and contribute to localized cooling. Suitable light, stretchable materials from which the coverings 31, 32 can be fabricated include Coolmax ®, a polypropylene blend, and Supplex ®, a blend of nylon and Lycra ®—both Dupont products.

Similarly, outer cloth coverings 27, 28, which span areas of the bra 30 located downwardly and rearwardly of the coverings 31, 32, are made from a light, stretchable material which can be the same one as that used in making the latter. In the preferred embodiment, the coverings 27, 28 are joined together in the back by a vertical seam and are stitched to the coverings 31, 32, respectively (FIG. 1)

The harness members 12, 13, in contrast to the coverings 27, 28; 31, 32, are made from a non-stretchable, washable material, which preferably can be die cut without fraying. In the preferred embodiment, the harness members 12, 13 are fabricated from 100 percent rayon backed with a blend of 50 percent polyester and 50 percent cotton. Alternately, this non-stretchable material can be a blend of 90 percent cotton and 10 percent polyethylene, a widely used fabric. Sources for the 100 percent rayon with polyester-and-cotton blend backing and for the 90 percent-cotton-and-10 percent-polyethylene blend include Sommers Inc. of Clifton, N.J. 07015 and Colortex International of Philadelphia, Pa. respectively.

For added support, when necessary, underwires 43, 44, each of which is held in place by a flange 3, 4, are provided (FIGS. 7, 8) Each of the flanges 3, 4 is double stitched to one of th harness members 12, 13. A suitable underwire 43, 44 is manufactured by S & S Industries in Bronx, N.Y.

Proximate with the frontal opening in which is mounted i cups 5, 6 but disposed upwardly of the underwire 43, 44 in each harness member 12, 13 is a small elastic insert 14, 15 (FIGS. 3, 5–8). Located between the strap junctures 24 and 34 and 25 35, respectively, the inserts 14, 15 make the harness members 13 sufficiently flexible that a wearer can enjoy a high degree freedom of motion while at the same time having her breast fully supported. In the preferred embodiment, each insert 14, 15 measures by way of example about ⅝ inch long and can easily stretched to about 1¼ inches under a force of only 5 pounds. A suitable material from which to fabricate inserts 14, 15 is made by Rhode Island Textile Co., located in Pawtucket, R.I. 02862.

Figure 2:
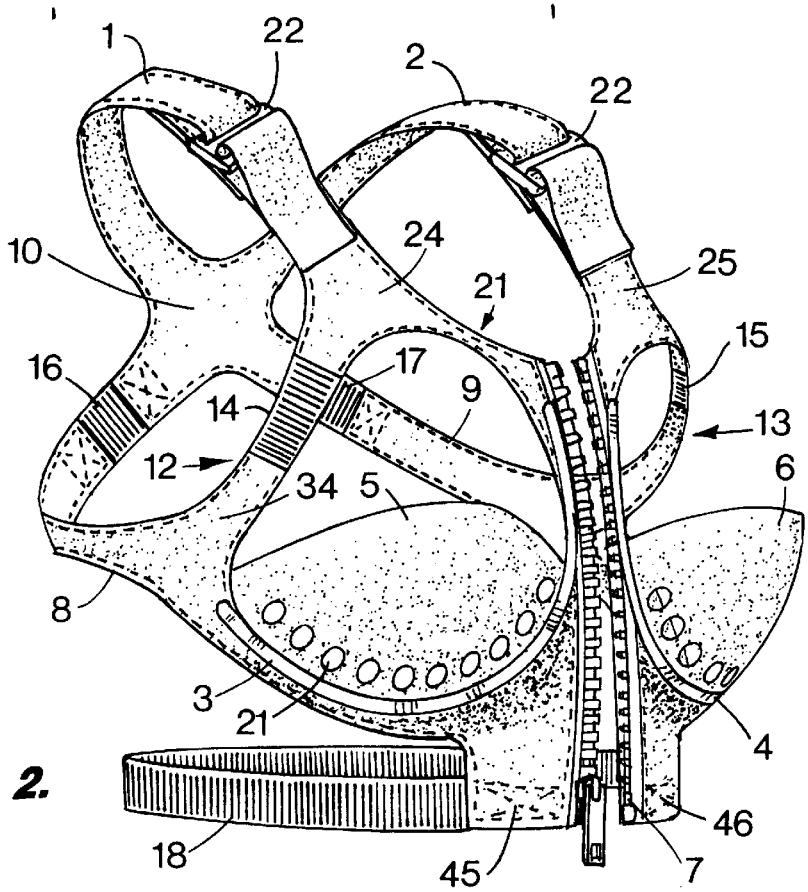
FIG. 2 is a frontal right side perspective view of the sports bra according to FIG. 1, in which an outer cloth covering has been removed, exposing the harness members and a pair of preformed cups attached thereto.
Figure 3:
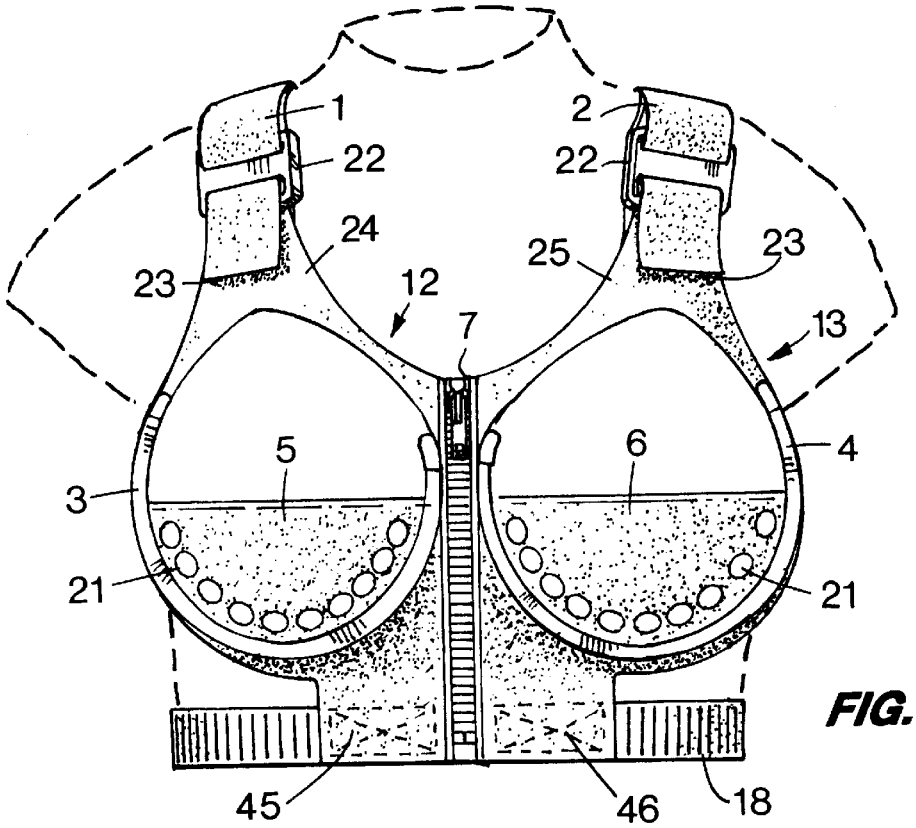
FIGS. 3 and 4 are frontal and rear elevational views, respectively, of the sports bra, in which, as illustrated in FIG. 2, the outer cloth covering has been removed, the dashed line showing the torso of a typical user and forming no part of the claimed invention.
Figure 4:
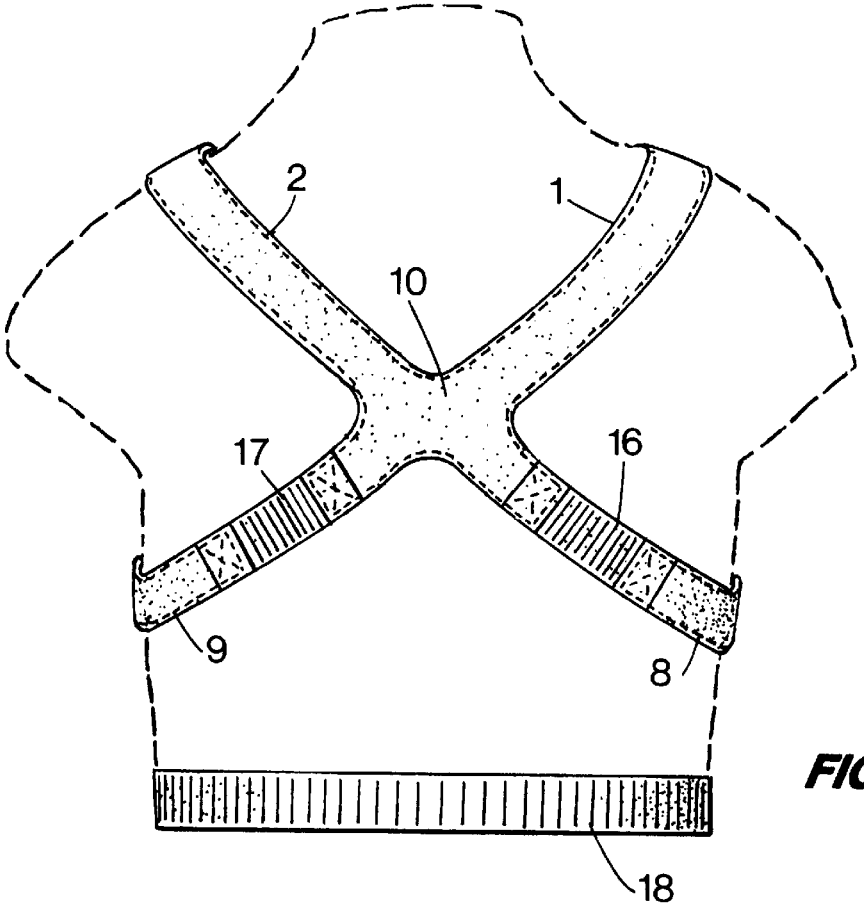
Figure 5:
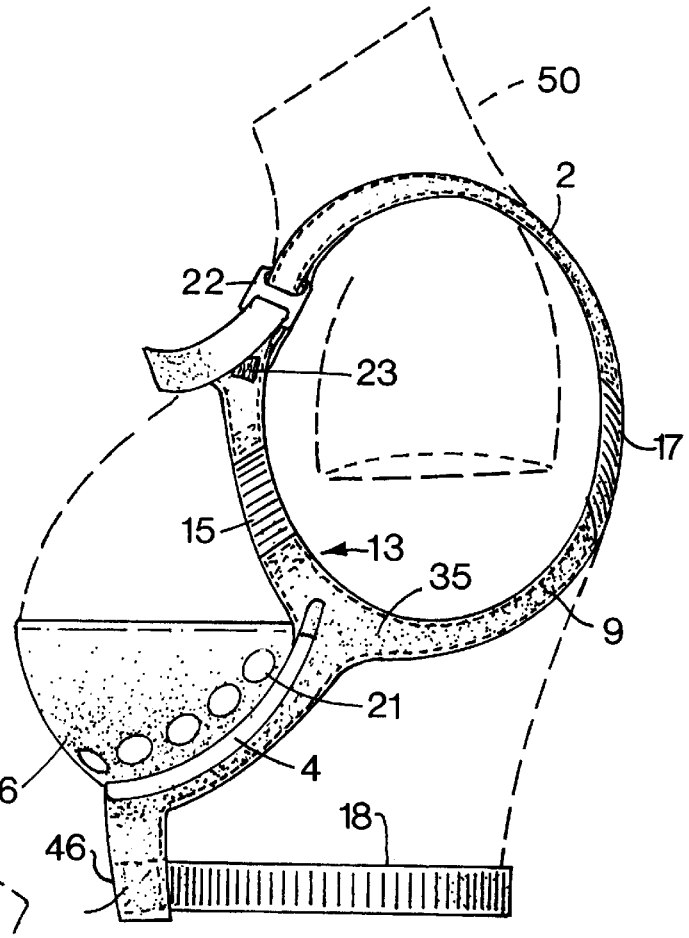
FIGS. 5 and 6 are left and right side elevational views, respectively, of the sports bra according to FIG. 1, in which the outer cloth covering has been removed as in FIG. 2, the dashed line showing the torso of a typical user and forming no part of the claimed invention.
Figure 6:
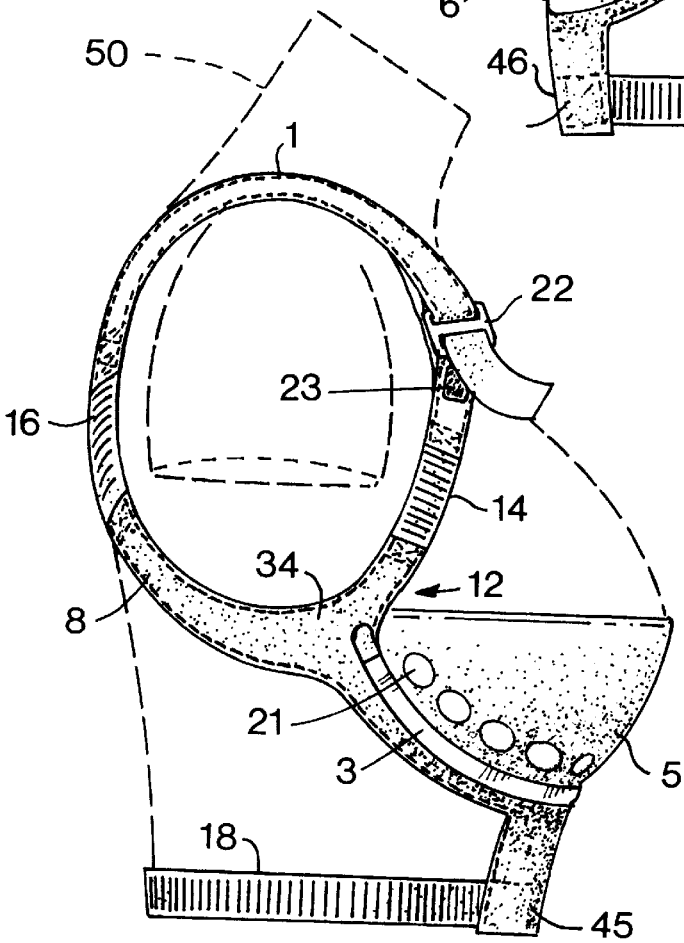

The harness members 12, 13 not only support the breast covering elements 5, 6; 31, 32, flanged liners 55, 56 and underwires 43, 44 but also form attachment points for shoulder straps 1, 2, underarm straps 8, 9, and the zipper 7 (FIGS. 1–8). Extending upwardly from their junctures 24, 25 with the upper edges of harness members 12, 13, respectively, are shoulder straps 1, 2; the underarm straps 8, 9, on the other hand, extend laterally and rearwardly from their junctures 34, 35, respectively, with the harness members 12, 13 (FIGS. 2, 5, 6). The junctures 34, 35 are disposed roughly on the same imaginary horizontal plane as that in which the center of the breast or nipple lies (FIGS. 5, 6). Distal ends of the shoulder straps 1, 2 and of the under-arm straps 8, 9 meet to form a yoke 10 which, in use, is located in the center of a wearer's back (FIG. 4). In the preferred embodiment, both the shoulder straps 1, 2 and the underarm straps 8, 9 measure, by way of example, about 1 inch in width and are made of the same material or, alternately, of a similar material to that used in fabricating the harness members; 12, 13.

Constructued in two parts joined together by a buckle 22, each shoulder strap 1, 2 can be adjusted in length. Once the most comfortable length has been attained, the straps 1, 2 can be held in that position. Means for so holding the straps 1, 2 includes interlock Velcro ®-type , hook and loop fasteners 23 affixed to each strap 1, 2. For added comfort, a pad 26 can be placed between the buckle 22 and the user's shoulder (FIG. 1).

For extra flexibility and freedom of motion, there is also provided a pair of second small elastic inserts 16, 17 located under in the underarm straps 8, 9, respectively, (FIGS. 2, 4, 5–8). In the preferred embodiment, each insert 16, 17 measures, by way of example, about 1 inch long and can be easily stretched tc about 2 inches in length under a force of only 5 pounds. Suitable elastic inserts material is available from Rhode Island Textile Co., located in Pawtucket, R.I. 02862. The second elastic insert 16, 17, together with the first elastic inserts 14, 15, allow the wearer 50 to move and have a full, yet non-binding support for her breasts.

Extending downwardly from the harness members 12, 13 are panels 45, 46 which reinforce junctures between the waistband and the zipper 7 (FIGS. 2, 3, 5–8). In the preferred embodiment the panels 45, 46 are fabricated of the same materials as the harness members 12, 13 and are formed integrally therewith.

Encircling the wearer's rib cage about 1 or 2 inches below the breasts, the waistband measures from 1 to 1½ inches in width. Suitable material from which to fabricate the waistband 18 is available from Rhode Island Textile Co. located in Pawtucket, R.I. 02862.

The zipper 7, elements of which are attached to both harness members 12, 13, extends substantially the entire length thereof from points proximate with the ends of the waistband 18 to points lying midway between, and slightly downwardly of, the shoulder straps junctures 24, 25 (FIG. 3) In the preferred embodiment, the zipper 7 measures, by way of example, about 8 inches in length and is isolated from the wearer's body by a pad (not shown). A suitable zipper is manufactured by YKK, located in Marietta, Ga. 30066.

To facilitate closure of the zipper 7, one or more small hock and eye-type fasteners 19 and 20 are preferably used to bring the two harness members 12, 13 together prior to closing the zipper (FIG. 7).

Although the improved sports bra according to the present invention can be marketed in standard sizes such as 34 D or 36 DD, for example, custom-fitting the bra 30 is highly desirable By cystom-fitting it, the degree of support which the bra 30 offers can be optimized for the individual wearer 50. A chart which includes those measurements which need to be taken to custom fit the bra 30 is as follows:

| CUSTOM-FITTING THE BRASSIERE | | |
|---|---|---|
| Cup Size: | (D, DD, DDD, or E) | |
| Breast Condition: | (Firm, Slight Sag, Moderate Sag, Full Sag) | |
| Girth Measurement, Inches: | | |
| (a) Underarm | | |
| (b) Top Bust | | |
| (c) Under Breast | | |
| Distance Measurement, Inches: | Right | Left |
| (a) Shoulder to Underarm: | — | — |
| (b) Shoulder to Nipple: | — | — |
| (c) Shoulder to Under Breast: | — | — |

It is understood that those skilled in the art may conceive other applications, modifications, and/or changes in the invention described above. Any such applications, modification, or changes which fall within the purview of the description are intended to be illustrative and not intended to be limitative. The scope of the invention is limited only by the scope of the claims appended hereto.

It is claimed:

1. A sports bra adapted to be worn by large breasted women, comprising:

(a) a pair of harness members, each harness member, in use, encircling a wearer's breast and defining an opening therefor;

(b) an adjustable shoulder strap which is connected to and extends upwardly from the harness member;

(c) an underarm strap which is connected to and extends laterally and rearwardly from the harness member, ends of the underarm strap and of the shoulder strap which are disposed distal from the harness member being joined to form a yoke, the yoke being worn on the wearer's back;

(d) at least one preformed cup mounted within the harness member, the cup covering generally about one-half of the opening defined thereby;

(e) an elastic waistband which is attached to the harness member generally downwardly of the preformed cup;

(f) an underwire;

(g) means attached to the harness member for holding the underwire in close proximity to bottom edges of the cup; and (h) means for removably attaching portions of the pair of harness members together, said portion of each harness member being disposed proximate with the preformed cup mounted therewithin.

2. The sports bra according to claim 1 which further comprises at least one elastic insert, the insert being disposed within the harness member between points connecting the shoulder strap and the underarm strap thereto, so as to allow the harness member to stretch to a limited extent, the harness member being generally fabricated of a material with a very low capacity for stretching.

3. The sports bra according to claim 1 which further comprises at least one elastic insert, the insert being disposed within the underarm strap, so as to allow the underarm strap to stretch to a limited extent, the underarm strap being generally fabricated of a material with a very low capacity for stretching.

4. The sports bra according to claim 1 which further comprises at least one first elastic insert and at least one second elastic insert, the first elastic insert being disposed within the harness member between points connecting the shoulder strap and the underarm strap thereto; the second elastic insert being disposed within the underarm strap, so as to allow the harness member and the underarm strap to stretch to a limited extent, both the barness member and the underarm strap being generally fabricated of a material with a very low capacity for stretching.

5. A sports bra for large breasted women, comprising:

(a) a pair of harness members, each harness member defining a frontal opening;

(b) an adjustable shoulder strap which is connected to and extends upwardly from the harness member;

(c) an underarm strap which is connected to and extends laterally and rearwardly from the harness member, ends of the underarm strap and of the shoulder strap which are disposed distal from the harness member being joined to form a rearwardly disposed yoke;

(d) at least one preformed breast cup mounted within the harness member, the cup covering generally about one-half of the frontal opening;

(e) at least one first elastic insert, the first elastic insert being disposed within the harness member and contiguous with the frontal opening but spaced apart from the preformed cup, so as to allow the harness member to stretch to a limited extent, the harness member being generally fabricated of a material with a very low capacity for stretching; and (f) means for removably attaching portions of the pair of harness members together, said portion of each harness member being disposed proximate with the preformed cup mounted therewithin.

6. The sports bra according to claim 5 which further comprises:

(a) an underwire; and (b) means attached to the harness member for holding the underwire in close proximity to bottom edges of the cup.

7. The sports bra according to claim 5 which further comprises an elastic waistband which is attached to the harness member generally downwardly of the preformed cup.

8. The sports bra according to claim 5 which further comprises at least one second elastic insert, the second elastic insert being disposed within the underarm strap, so as to allow the underarm strap to stretch to a limited extent, the underarm strap being generally fabricated of said material with a very low capacity for stretching.

* * * * *